US011149396B2

(12) United States Patent
Zuckerman et al.

(10) Patent No.: US 11,149,396 B2
(45) Date of Patent: Oct. 19, 2021

(54) DEFORMATION-COMPLIANT RIGID INCLUSIONS WITH EMBEDDED STRUCTURAL REINFORCEMENTS

(71) Applicant: Berkel & Company Contractors, Inc., Bonner Springs, KS (US)

(72) Inventors: Brian Roblee Zuckerman, San Francisco, CA (US); Robert Eric Denman, Basehor, KS (US)

(73) Assignee: Berkel & Company Contractors, Inc., Bonner Springs, KS (US)

( * ) Notice: Subject to any disclaimer, the term of this patent is extended or adjusted under 35 U.S.C. 154(b) by 0 days.

(21) Appl. No.: 16/825,390

(22) Filed: Mar. 20, 2020

(65) Prior Publication Data

US 2020/0299917 A1 Sep. 24, 2020

Related U.S. Application Data

(60) Provisional application No. 62/822,221, filed on Mar. 22, 2019.

(51) Int. Cl.
*E02D 5/30* (2006.01)
*E02D 5/38* (2006.01)
(Continued)

(52) U.S. Cl.
CPC ..... *E02D 5/30* (2013.01); *E02D 3/054* (2013.01); *E02D 3/08* (2013.01); *E02D 3/12* (2013.01); *E02D 5/38* (2013.01); *E21B 33/14* (2013.01)

(58) Field of Classification Search
CPC .... E02D 5/30; E02D 5/34; E02D 5/38; E02D 5/385
(Continued)

(56) References Cited

U.S. PATENT DOCUMENTS 805,936 A * 11/1905 Shuman ..... E02D 5/36 405/239
999,431 A * 8/1911 Beall ..... E02D 5/36 405/239
(Continued)

FOREIGN PATENT DOCUMENTS

CN 106087979 * 11/2016
CN 106192993 * 12/2016
(Continued)

OTHER PUBLICATIONS

FiReP Soft-Eye Introduction: GFRP Reinforcement, Jan. 18, 2012, FiReP Fiber Reinforced Polymer, pp. 1-10. (Year: 2012).*
(Continued)

*Primary Examiner* — Frederick L Lagman
(74) *Attorney, Agent, or Firm* — Hovey Williams LLP; Kameron D. Kelly

(57) ABSTRACT

Soil inclusions (30) comprising an elongated, cured cementitious columnar body (72) are located within the soil (32) and include a tubular perforate structural reinforcement (56*a*, 56*b*) embedded within the body (72), with portions of the body exuded through the perforations (57) of the structural reinforcement (56*a*, 56*b*). The inclusions (30) are formed by driving a tubular mandrel (44) through vibratory means into the soil (32), with a flexible, tubular, perforate reinforcement (56*a*, 56*b*) about the exterior surface of the mandrel (44). When the mandrel (44) is fully driven, it is withdrawn, and simultaneously cementitious material (70) is injected into the mandrel (44). The material (70) exudes through the perforations (57) to complete the inclusion (30), which is deformation compliant. The inclusions may be installed in vertical or non-vertical orientations.

21 Claims, 6 Drawing Sheets

(51) Int. Cl.
*E02D 3/08* (2006.01)
*E02D 3/12* (2006.01)
*E21B 33/14* (2006.01)
*E02D 3/054* (2006.01)

(58) Field of Classification Search
USPC ..... 405/239, 240, 242
See application file for complete search history.

(56) References Cited

U.S. PATENT DOCUMENTS 1,062,718 A * 5/1913 Layne ..... E02D 5/36 405/239
2,146,645 A * 2/1939 Newman ..... E02D 5/385 405/239
2,789,419 A * 4/1957 Pickman ..... E02D 5/44 405/237
3,638,433 A * 2/1972 Sherard ..... E02D 1/04 405/50
4,917,542 A * 4/1990 Hickey ..... E02D 5/385 405/231
5,050,356 A * 9/1991 Johnson ..... E02D 27/42 52/295
5,542,785 A * 8/1996 Cloud ..... E02D 5/34 249/83
5,599,599 A * 2/1997 Mirmiran ..... B29C 70/865 428/120
5,836,715 A * 11/1998 Hendrix ..... B29C 70/222 404/134
6,123,485 A * 9/2000 Mirmiran ..... E02D 31/02 405/232
6,244,014 B1 * 6/2001 Barmakian ..... B29C 45/14549 52/834
6,263,629 B1 * 7/2001 Brown, Jr. ..... E04C 2/044 442/179
8,677,720 B2 * 3/2014 Carson ..... E04C 3/34 52/831
2015/0354162 A1 * 12/2015 Bonomi ..... E02D 27/14 405/287.1

FOREIGN PATENT DOCUMENTS

DE 3131559 * 5/1983
JP 360212514 A * 10/1985

OTHER PUBLICATIONS

FiReP Rebar, 2005-2016, http://en.firepworld.com/products/firep-rebar.*
Mechanical Properties of Carbon Fibre Composite Materials, Fibre/Epoxy resin, Jul. 2009, Performance Composites Ltd., http://www.performance-composites.com/carbonfibre/mechanicalproperties_2.asp.*
Fiber-reinforced Polymer Composites, Engineering ToolBox, (2008). Fibre-reinforced Polymer Composites, [online] Available at: https://www.engineeringtoolbox.com/polymer-composite-fibers-d_1226.html.*

* cited by examiner

DEFORMATION-COMPLIANT RIGID INCLUSIONS WITH EMBEDDED STRUCTURAL REINFORCEMENTS

CROSS-REFERENCE TO RELATED APPLICATION

This application claims the benefit of U.S. Provisional Application Ser. No. 62/822,221 filed Mar. 22, 2019, which is incorporated by reference herein in its entirety.

BACKGROUND OF THE INVENTION

Field of the Invention

The present invention is broadly concerned with improved, deformation-compliant rigid soil inclusions, and methods of fabricating such inclusion. More particularly, such inclusions have embedded perforate reinforcements along the lengths thereof, which are structurally significant and maintain the integrity of the inclusions even under seismic ground motion or other loading causing induced bending deformation. Methods of fabricating the inclusions involve driving a tubular mandrel into the soil having a flexible, tubular, perforate reinforcement applied about the exterior surface thereof, and thereafter withdrawing the mandrel while injecting flowable cementitious material into the mandrel, thereby causing the material to form a columnar body, substantially circular in cross-section, with portions of the body exuded through the perforations of the reinforcement.

Description of the Prior Art

Traditional cast-in-place piles used as structural supports incorporate steel reinforcing bars within poured concrete or grout structures extending from the supported structure to firm soil or rock at depth. Such piles are essentially elements of the structure extended into the ground. However, another type of support is referred to as a "rigid inclusion," which is not an extension of the structure, but a reinforcement of the soil below the structure. Thus, in situations where the soil is soft or vulnerable, inclusions serve to transfer vertical loads through the soft soil to competent strata at depth. To this end, a plurality of relatively closely spaced rigid inclusions may be used to collectively strengthen the overall profile of the soil and transmit vertical loads.

Typically, prior art rigid inclusions are constructed by driving a tubular mandrel into the soil to a desired level followed by mandrel withdrawal and simultaneous grout injection through the bore thereof, in order to thereby fill the volume of the withdrawn mandrel.

Unfortunately, these types of inclusions are of little use in soils subject to cycles of shear and flexure due to kinematic and inertial deformation of the surrounding soil, e.g., seismic ground motion or similar vibrations. This is because the inclusions, while initially having significant compressive strength, have virtually no strength to resist shear and flexural deformation, which create tension within the element. Therefore, such prior inclusions are likely to sustain severe cracking, crushing and separation when subjected to shear and flexural deformation due to a seismic event. Thus, following such an event, the inclusions will be unable to support vertical loads, potentially leading to unacceptable settlements and the need to conduct extensive repairs. Stated otherwise, these conventional inclusions are not deformation compliant because, once fractured, the inclusions are no longer capable of operating as intended.

Prior art references include U.S. Pat. Nos. 3,270,469, 3,611,735, 3,726,950, 4,715,203, 5,213,449, and 6,672,015; US Patent Publications Nos. 2004/0016564, 2010/0277290, and 2018/0071949; and foreign references DE 102012004980A1, MX2014015383A, and WO1990015905. Related videos can be found in the You Tube videos found at https://www.youtube.com/watch?v=9R2N13ggXbg and https://www.youtube.com/watch?v=OaltjBxiQY.

There is accordingly a need in the art for improved soil inclusions which are deformation compliant, and corresponding methods of creating such inclusions.

SUMMARY OF THE INVENTION

The present invention overcomes the problems described above, and provides deformation-compliant soil inclusions, as well as methods of fabrication thereof. Such inclusions broadly comprise elongated, cast-in-place cured cementitious columnar bodies located within the soil, each having a tubular perforate structural reinforcement embedded within the body in the form of a continuous, non-orthotropic grid, with portions of the body exuded through the perforations of the structural reinforcement. Such reinforcements extend substantially the entire lengths of the bodies and are usually formed of non-metallic composite material (e.g., carbon or glass fiber infused with a synthetic resin, such as epoxy). The cementitious material provides compressive strength and stiffness, while the reinforcement provides flexural strength, shear strength and lateral confinement. These improved capabilities give the inclusions the capability of sustaining repeated cycles of kinematic and inertial deformations in the surrounding soil, while maintaining their original capacity for vertical load transfer. Accordingly, the deformation compatible inclusions provide continued foundation support following a seismic event—a capability not provided by inclusions of the prior art.

Methods of forming the inclusions hereof comprise the steps of first driving a tubular mandrel into the soil with a vibratory hammer or like device, there being a flexible, tubular, perforate reinforcement about the exterior surface of the mandrel. Once fully driven, the mandrel is withdrawn while flowable cementitious material (e.g., grout) is injected into the mandrel during its withdrawal. This causes the cementitious material to form a columnar body, with portions of the body exuded through the perforations of the reinforcement in order to embed the tubular reinforcement within the body.

A sacrificial soil-driving shoe, slightly larger than the mandrel in diameter, is attached to the end of the mandrel prior to the driving step, and the reinforcement is secured to the shoe. The reinforcement may be applied by wrapping around the exterior surface of the mandrel as it is driven, or by initially placing a pre-formed tubular reinforcement about the mandrel before driving thereof.

Typically, the inclusions of the invention have a length of from about 10-50 feet, and the embedded structural reinforcements extend substantially the full lengths of the inclusions.

DETAILED DESCRIPTION OF THE PREFERRED EMBODIMENT

Figure 2:
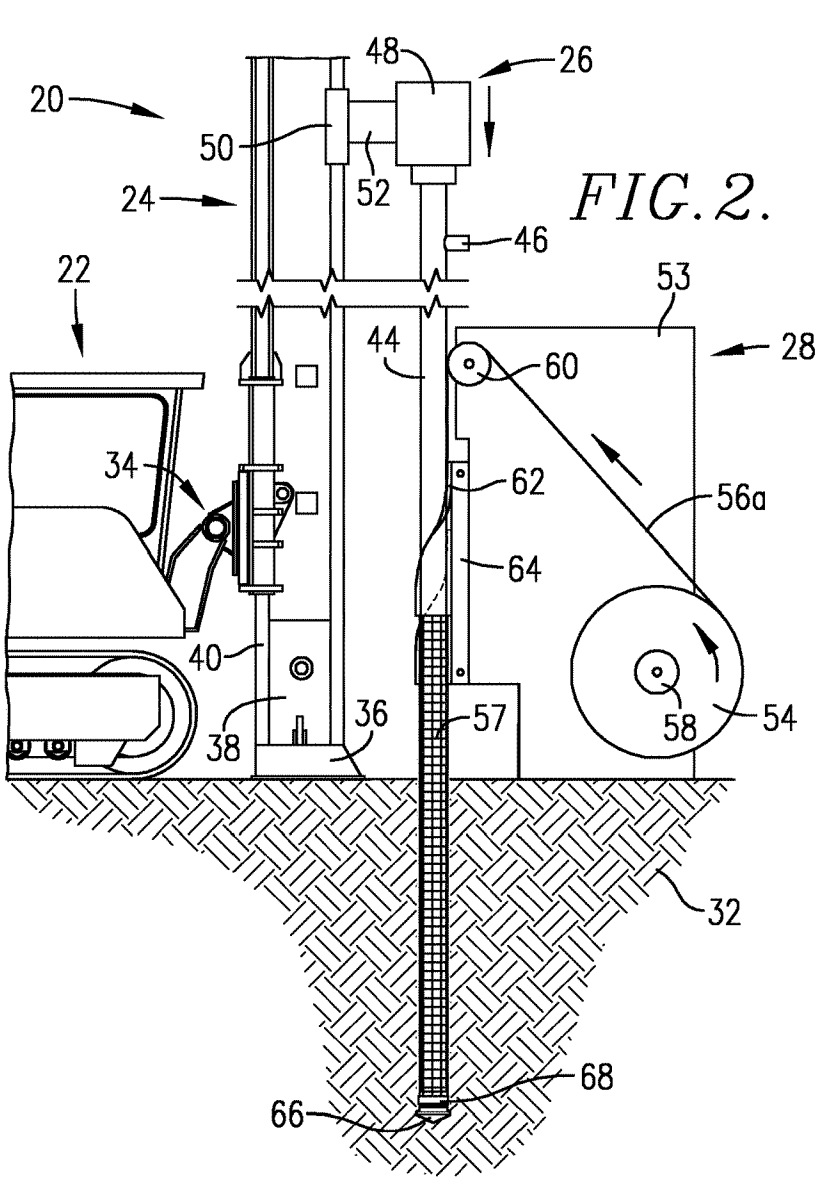
FIG. 2 is a view similar to that of FIG. 1, but illustrating driving of the mandrel into the soil while simultaneously wrapping above-grade portions of the mandrel with the structural reinforcement, with addition of a sacrificial shoe onto the mandrel, and prior to driving of the mandrel into the soil.
Figure 1:
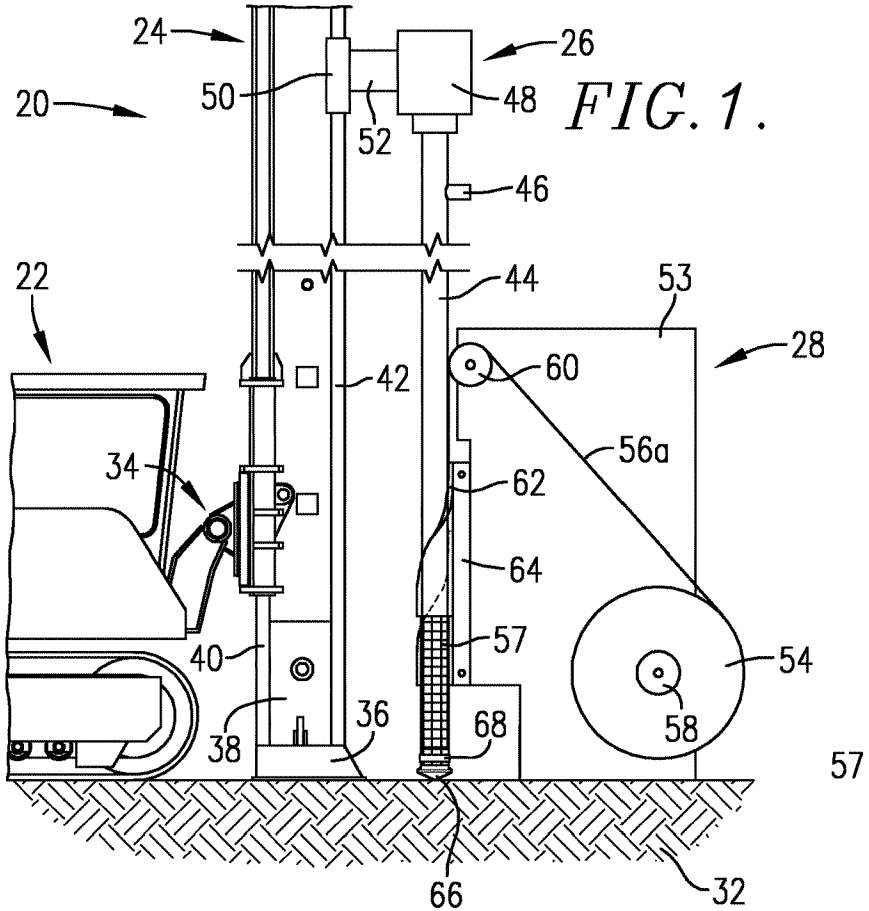
FIG. 1 is a fragmentary side schematic view illustrating a piling rig in accordance with the invention, during an initial stage in a method of forming a rigid inclusion with a mandrel and a partial wrapping of perforate structural reinforcement about the mandrel.

Turning now to the drawings, a piling rig 20 is illustrated, which broadly includes a tracked vehicle 22, a primary support column 24, a mandrel drive unit 26, and a structural reinforcement application assembly 28. The rig 20 is designed to efficiently create a series of discrete inclusions 30 within the soil 32.

In more detail, the support column 24 is secured to vehicle 22 by means of an articulated coupler 34, allowing the rig to be moved from place to place for creation of inclusions. The support column 24 includes a stabilizing base 36 with an upstanding rigid metallic web 38. A pair of side rails 40 and 42 also form a part of the column 24. As illustrated, the coupler 34 engages the rail 40, allowing the column 24 to be bodily moved during the use of rig 20.

Figure 4:
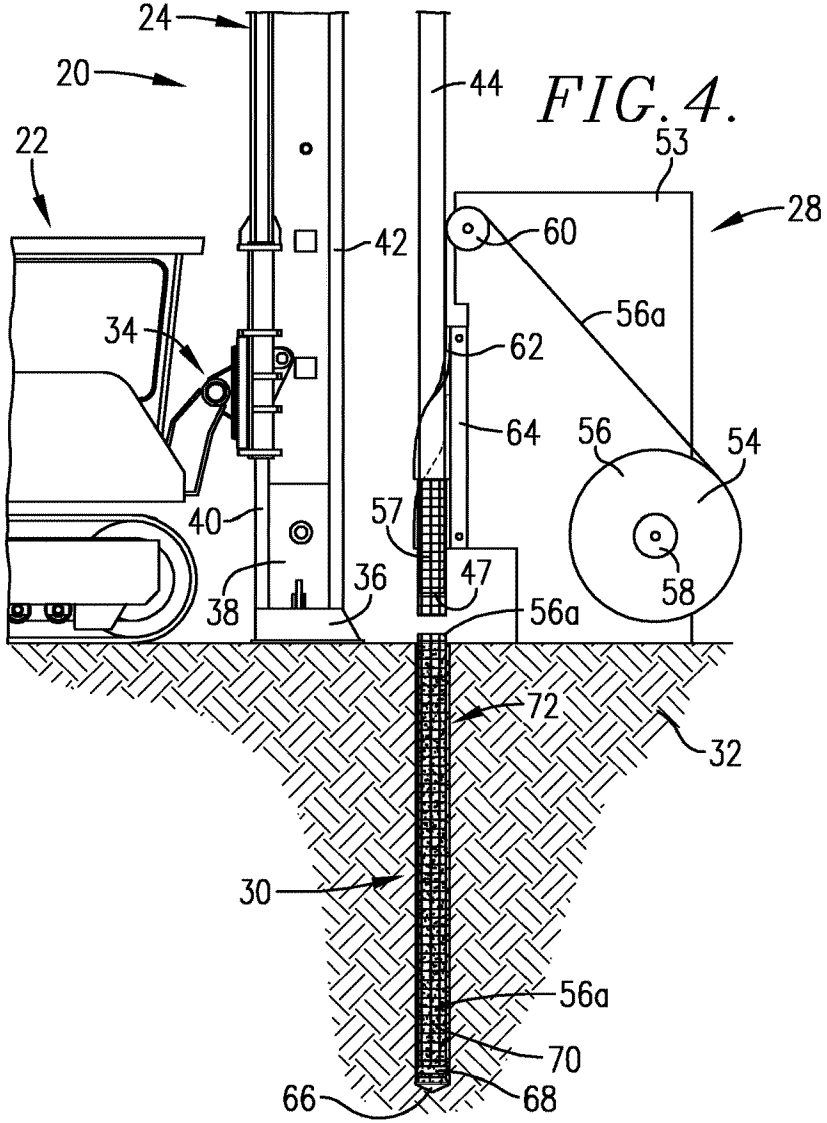
FIG. 4 is a view similar to that of FIG. 3, but illustrating the fully-formed inclusion after complete withdrawal of the mandrel.

The mandrel drive unit 26 is designed to engage and drive a tubular mandrel 44 having an upper grout inlet 46 and a lower butt end 47 (FIG. 4). The upper end of the mandrel 44 is coupled with a hydraulic vibratory hammer 48, with the hammer supported on rail 42 for up and down movement by means of a tubular mount 50 and connector 52. The application assembly 28 includes an upright support 53 mounting a roll 54 of perforate reinforcing material 56. The roll 54 is mounted on a spindle 58 secured to support 53. As illustrated, the material 56 passes from roll 54, around a guide roller 60, and then, via a guide slot 62 defined by a wrapping bar 64 adjacent mandrel 44, is wrapped about mandrel 44, as will be explained.

FIGS. 1-4 illustrate an embodiment of the invention making use of reinforcing material 56 in the form of a simple web **56*a* provided with perforations 57 along the length thereof. In this embodiment, the inclusion 30 is created by first wrapping a portion of the web 56*a* about the lower end of the mandrel 44. Thereupon, a sacrificial shoe 66 is mounted on the lower end of the mandrel 44, and the web 56*a* is secured to the shoe 66 by a compression ring 68** or similar expedient.

Figure 3:
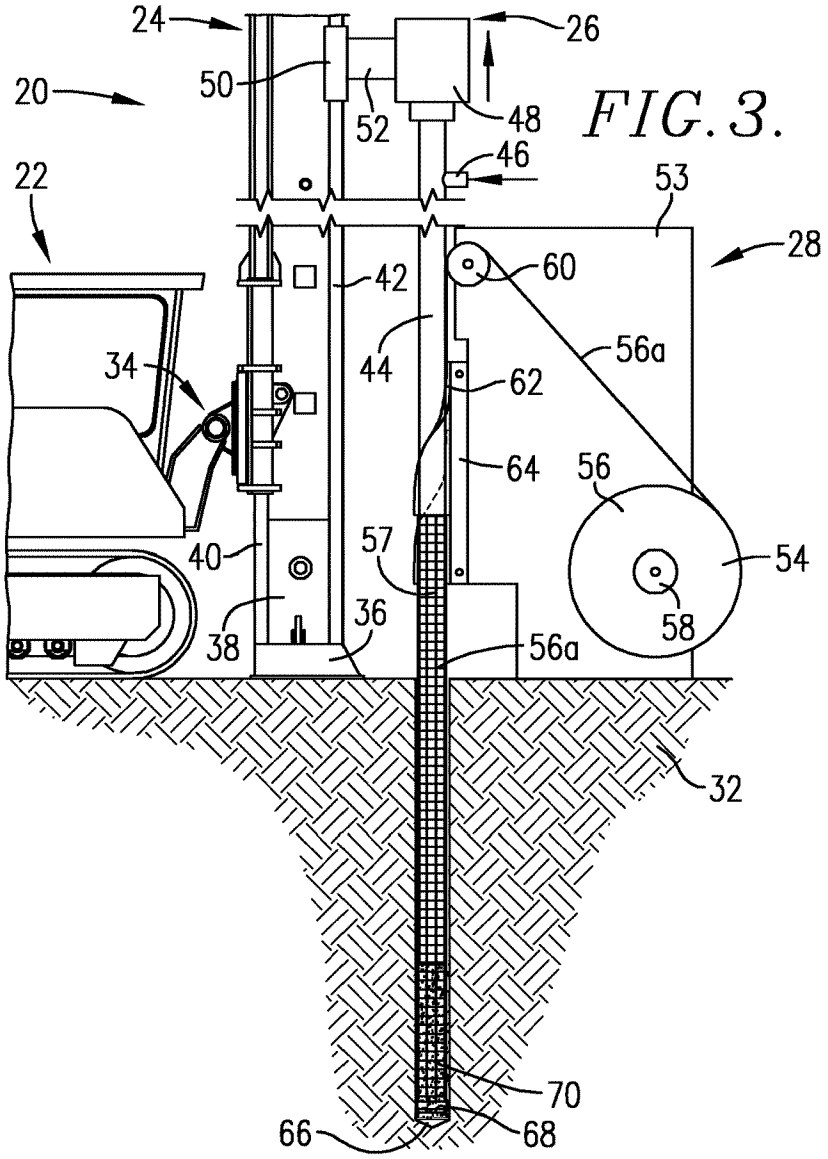
FIG. 3 is a view similar to that of FIG. 2, but illustrating injection of grout into the fully-driven mandrel during simultaneous withdrawal thereof.
Figure 9:
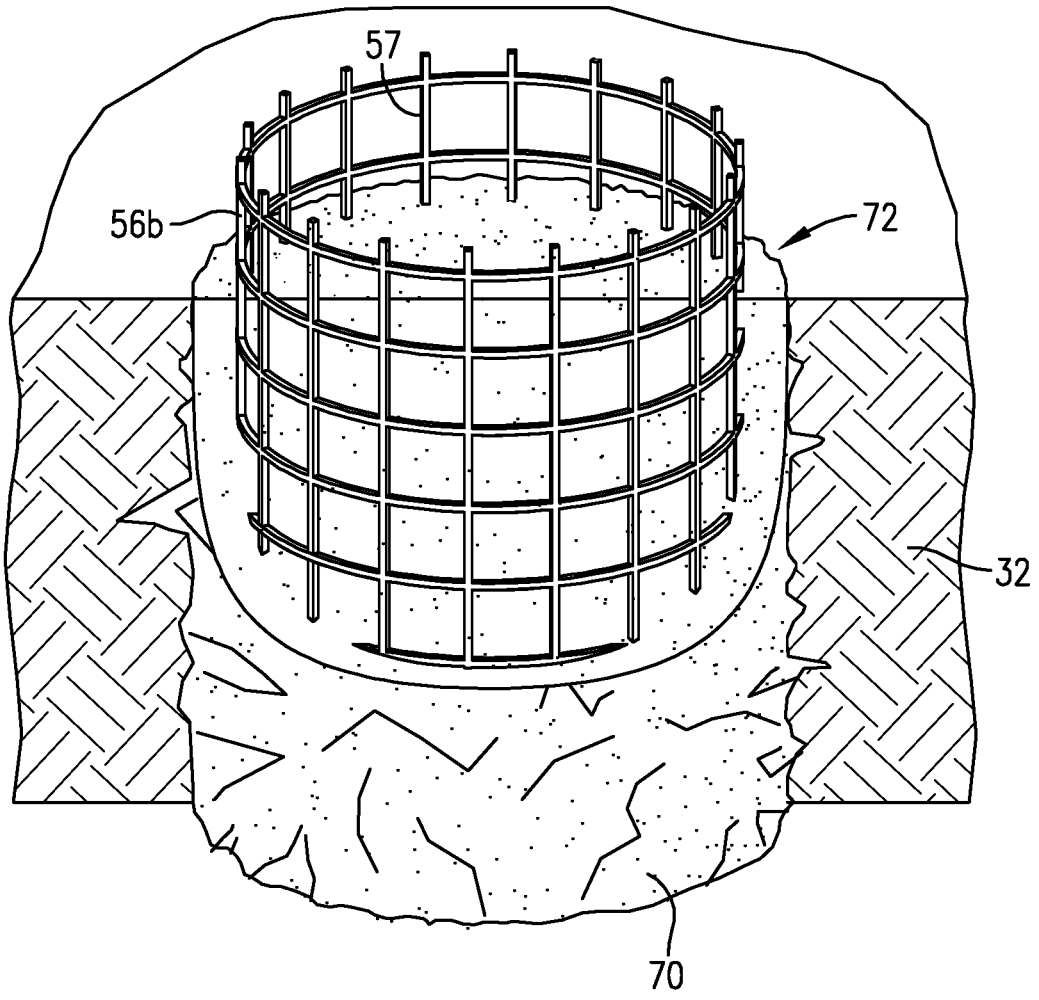
FIG. 9 is a fragmentary perspective view of the construction of an inclusion in the soil, and illustrating the perforate structural reinforcement embedded within the inclusion.

Next, the hammer 48 is actuated (FIG. 2), which serves to drive the mandrel 44 into the soil 32. As this occurs, additional portions of the web **56*a* are drawn from roll 54 and wrapped about the mandrel 44 so that the entirety of the outer surface of the mandrel 44 is covered with the web 56*a* (FIG. 3). At this point, cementitious grout 70 is injected via inlet 46 to begin filling the mandrel 44 with the grout 70. Simultaneously, the mandrel 44 is withdrawn, which detaches the shoe 66 and allows the grout 70 to completely fill the region formerly occupied by the mandrel 44. Once the mandrel 44 is fully withdrawn, the web 56*a* is severed (FIG. 4), leaving the shoe 66 and the now tubular web 56*a* in the soil 32. In addition, owing to the perforate nature of the web 56*a*, the grout 70 is exuded outwardly into the soil through the web perforations. As such, it will be observed that the tubular web 56*a* is essentially completely encased within the grout 70. Upon hardening of the grout 70, the result is a rigid columnar body 72 which is deformation-compliant (FIG. 9**).

Figure 10:
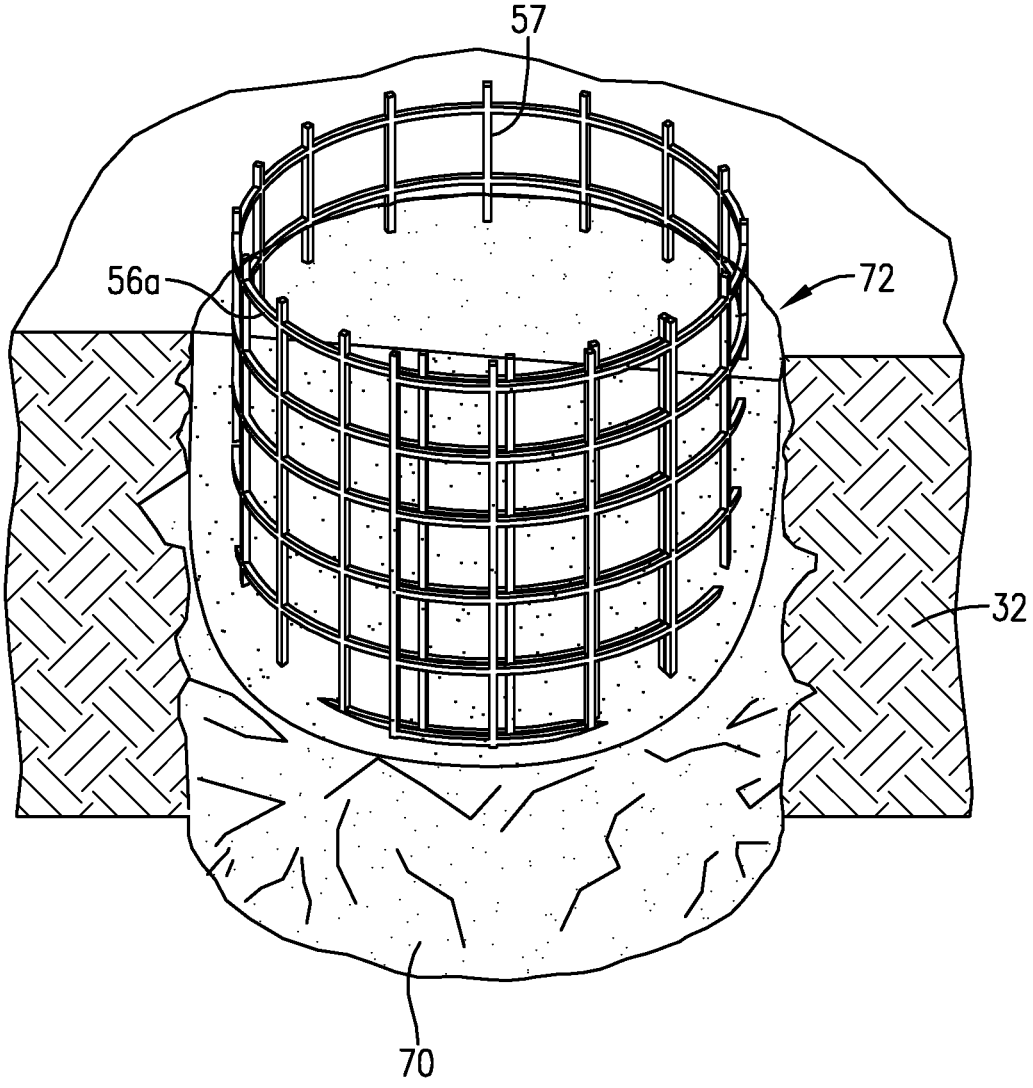
FIG. 10 is a view similar to that of FIG. 9, but illustrating another inclusion embodiment wherein the edges of the structural reinforcement are overlapped.

In this embodiment, the material **56*a* is provided as a flat sheet, with the edges overlapped, as illustrated in FIG. 10. The material 56*a* is embedded within the hardened grout 70 of the body 72**.

Figure 6:
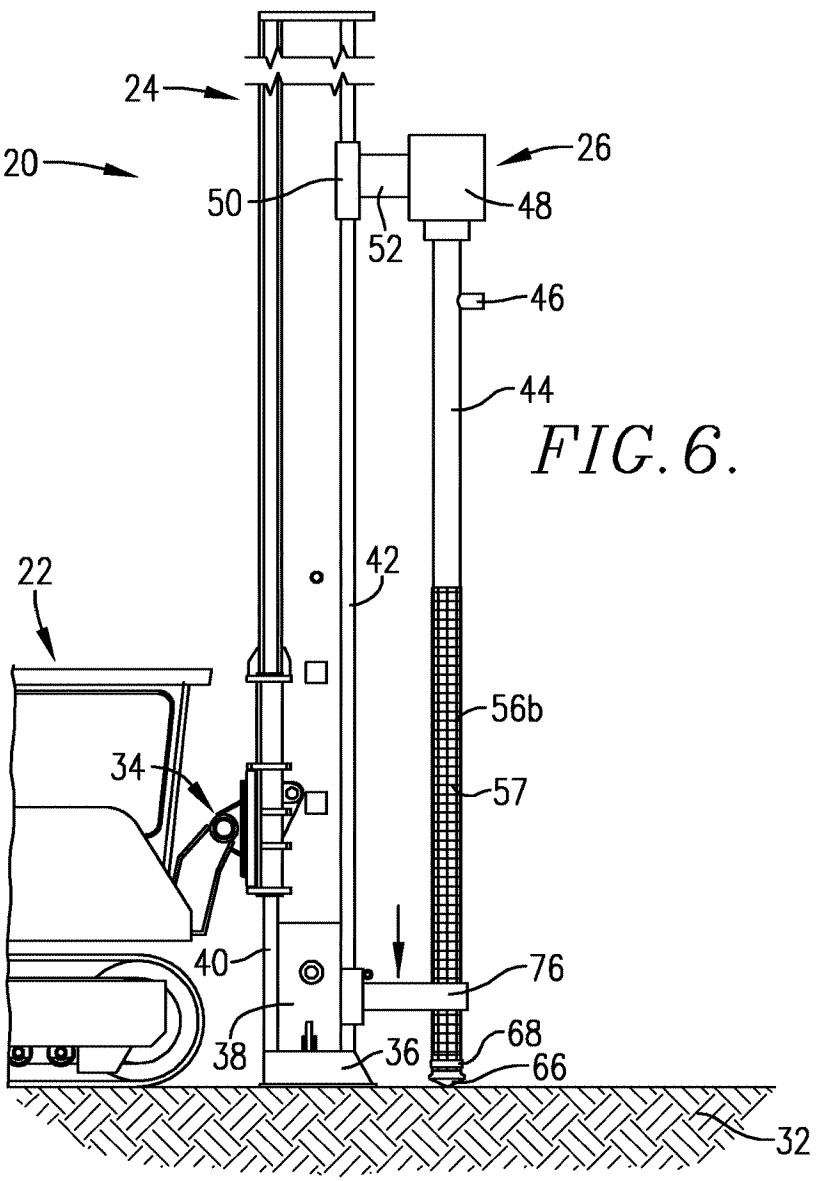
FIG. 6 is a view similar to that of FIG. 5, but illustrating the perforate material disclosed about the mandrel, and with addition of a sacrificial shoe onto the mandrel, and prior to driving of the mandrel into the soil.
Figure 5:
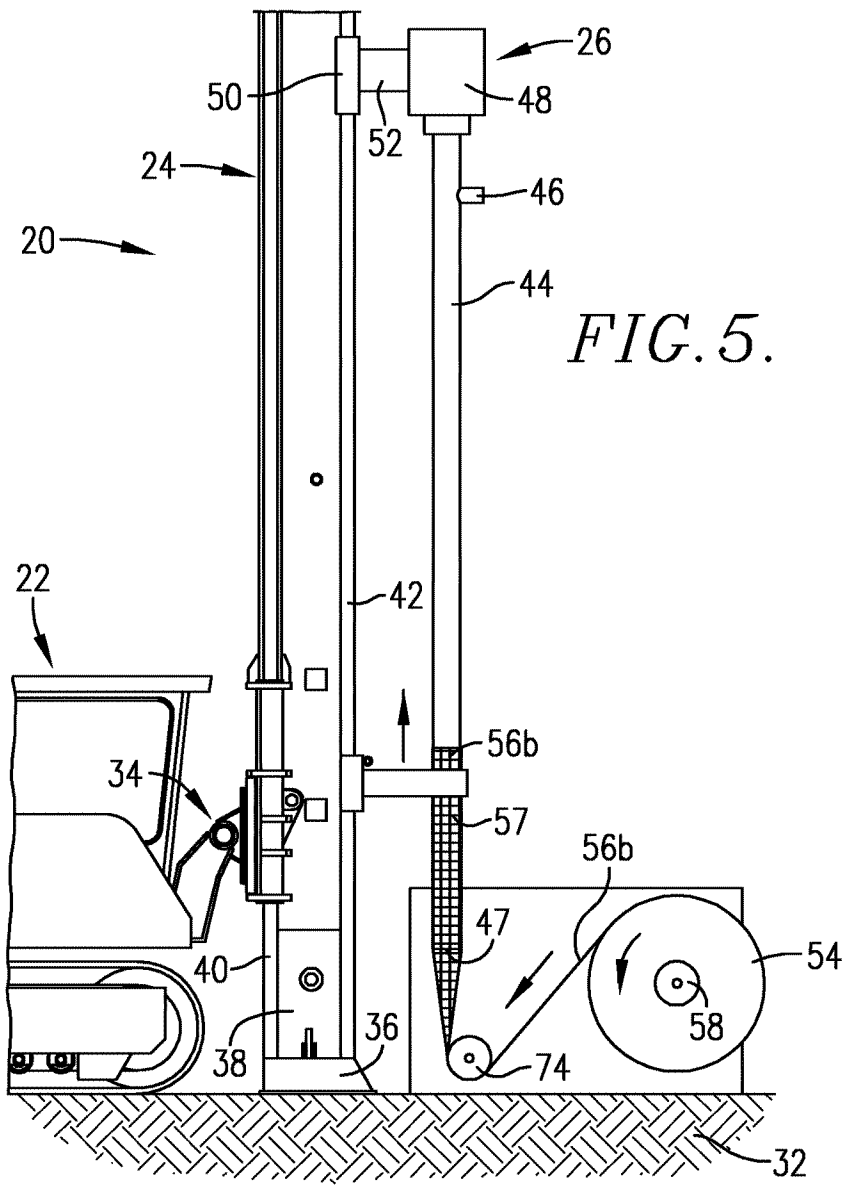
FIG. 5 is a is a fragmentary side schematic view illustrating a piling rig in accordance with the invention, during an initial stage in a method of forming a rigid inclusion, wherein a mandrel is enveloped within a tubular supply of perforate structural reinforcement.
Figure 8:
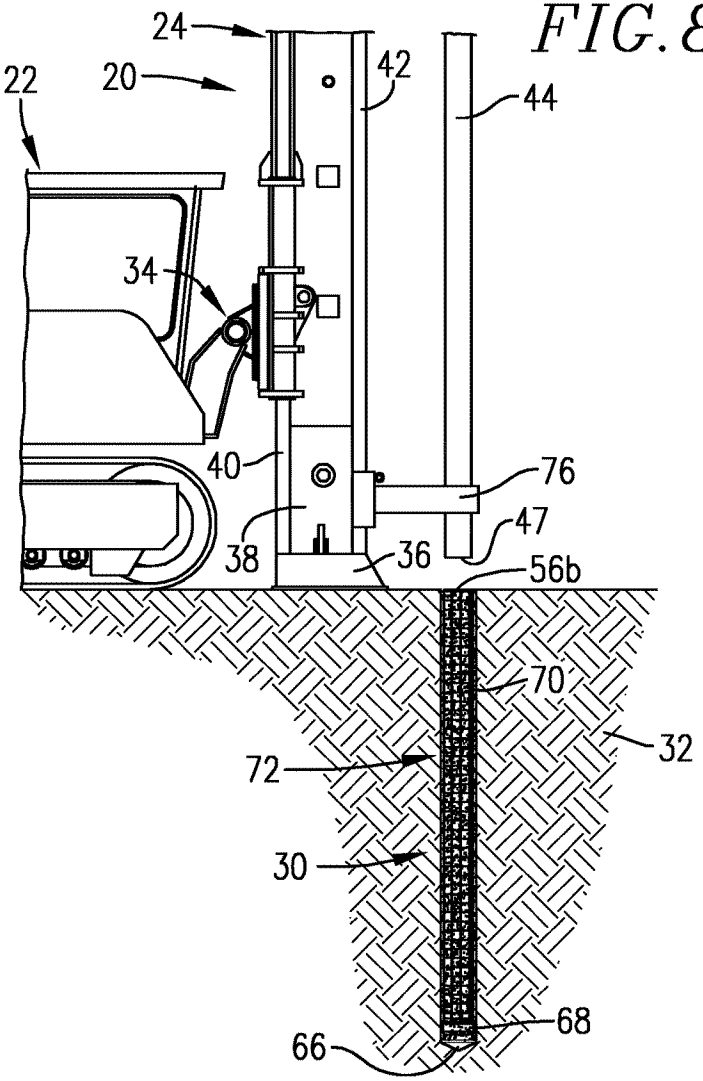
FIG. 8 is a view similar to that of FIG. 7, but illustrating the fully-formed inclusion after complete withdrawal of the mandrel.
Figure 7:
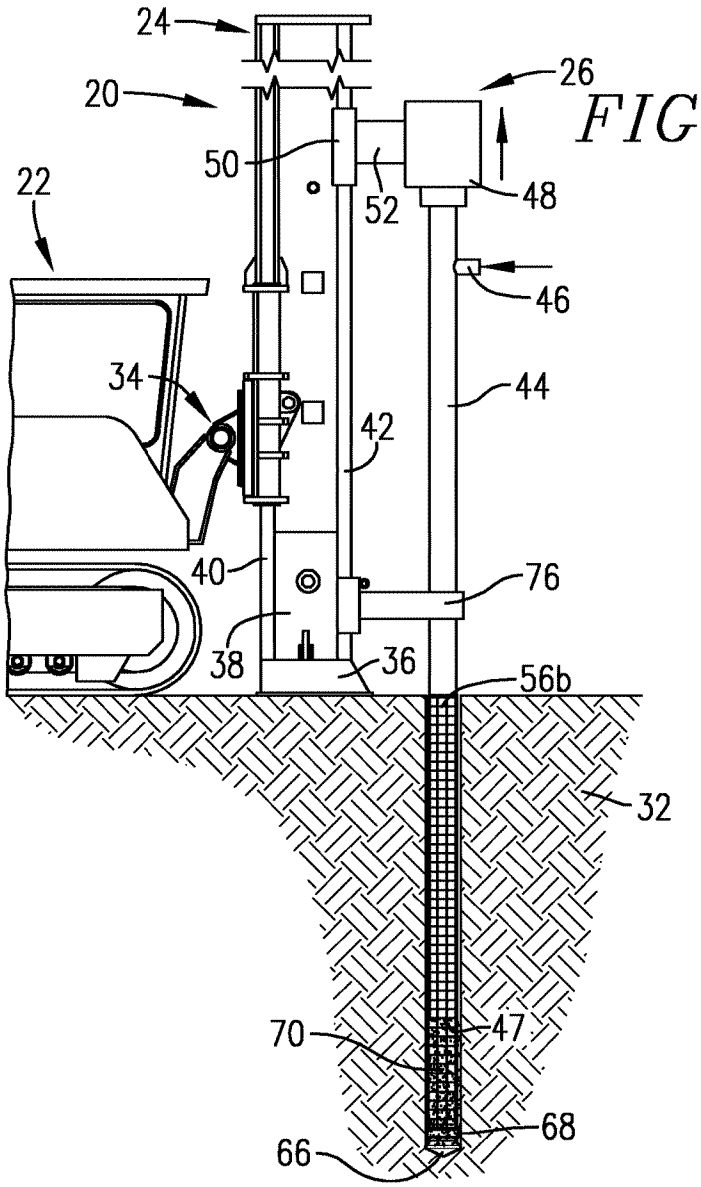
FIG. 7 is a view similar to that of FIG. 6, but illustrating the mandrel during withdrawal thereof and simultaneous injection of grout into the mandrel.

FIGS. 5-8 illustrate another embodiment in accordance with the invention, which in many respects is identical to the first embodiment. However, in this case, the roll 54 is in the form of tubular reinforcing material **56*b* having perforations 57, which extends around lower guide roller 74 and then upwardly to cover the mandrel 44, beginning at the lower butt end 47 thereof. In the first step of this embodiment, the tubular material 56*b* is first applied to the lower end of the mandrel 44, whereupon a shiftable gripping jaw 76 is employed to pull the material 56*b* upwardly, thereby drawing the tubular material from the roll 54 and along the length of the mandrel 44 until the entirety of the length of the mandrel to be used for the inclusion is covered by this material (FIG. 6). The lower end of the material 56*b* is then severed from the roll 56 and a sacrificial shoe 66 is mounted on the mandrel 44, again using a compression ring 68 or the like to secure the lower end of the material 56*b* to the shoe 66**.

The remaining steps of this embodiment are identical to those described previously, i.e., the material-wrapped mandrel 44 is driven into the soil via hammer 48. Once the wrapped section of the mandrel 44 is fully driven, grout 70 is then injected via inlet 46 to fill the mandrel 44, while the latter is withdrawn, thereby creating the columnar body 72 with grout exuding through the perforations of the material **56*b***.

The material **56*a* and 56*b* serves as a structural element within the body 72**. As such, the fiber materials should have a modulus of elasticity in the range of 10,000-30,000 psi and an ultimate strain of 0.01-0.015. Furthermore, the fiber material should have a thickness of from about 0.05-0.1 inches, with perforations having size of from about 0.5-1 square inches. The fibers in the longitudinal and transverse orientations may be of differing diameters.

While the invention has been illustrated and described in typical uses and installations, the invention is not limited in these particulars. For example, while the reinforcing material has been depicted with essentially square perforations 57, these can be of any shape. Further, while the inclusions illustrated in the drawings are in an upright orientation, the inclusions may be installed in a plumb or vertical condition, or in non-vertical orientations, e.g., inclined, battered, or raked. While it is presently contemplated that the reinforcing materials would be in the form of fiber-reinforced epoxy, other types of reinforced or non-reinforced materials could be employed.

We claim:

1. A soil inclusion comprising an elongated, cured cementitious columnar body located within the soil and including a tubular perforate structural reinforcement embedded within the body, with portions of the body exuded through perforations of the structural reinforcement, wherein said reinforcement is flexible with a thickness between 0.05 and 0.1 inches.

2. The inclusion of claim 1, said reinforcement extending substantially the entire length of said body.

3. The inclusion of claim 1, said reinforcement formed of composite material having glass or carbon fibers incorporated into synthetic resin material.

4. The inclusion of claim 1, said reinforcement having an ultimate strain of between 0.01-0.015.

5. The inclusion of claim 1, said body having a length of from about 10-50 feet.

6. The inclusion of claim 1, said body being vertical or non-vertical in orientation.

7. The inclusion of claim 1, wherein the perforations of said reinforcement have a size ranging from about 0.5-1 square inches.

8. A method of forming an inclusion, comprising the steps of:

driving a tubular mandrel into the soil, there being a flexible, tubular, perforate reinforcement about the exterior surface of said mandrel, with said reinforcement having a thickness in the range of 0.05-0.1 inches; and withdrawing said mandrel from the soil, injecting flowable cementitious material into the mandrel during withdrawal thereof, and causing the cementitious material to form a columnar body, with portions of the body exuded through perforations of said reinforcements in order to embed the tubular reinforcement within the body.

9. The method of claim 8, including the step of attaching a sacrificial shoe to the end of said mandrel prior to said driving step.

10. The method of claim 8, including the step of securing the lower end of said reinforcement to said mandrel, prior to driving the mandrel into the soil.

11. The method of claim 8, said reinforcement extending substantially the entire length of said body.

12. The method of claim 8, said reinforcement formed of composite material having glass or carbon fibers incorporated into synthetic resin material.

13. The method of claim 8, said reinforcement having an ultimate strain of between 0.01-0.015.

14. The method of claim 8, said body having a length of from about 10-50 feet.

15. The method of claim 8, said reinforcement being pre-formed as a tubular sleeve, including the step of applying said tubular sleeve over said mandrel prior to said driving step.

16. The method of claim 15, including the step of severing said tubular sleeve prior to said driving step.

17. The method of claim 16, including the step of securing the severed tubular sleeve to the lower end of said mandrel, prior to said driving step.

18. The method of claim 8, including the step of installing said body in the soil at a vertical or non-vertical in orientation.

19. The method of claim 8, wherein the perforate reinforcement is placed about the exterior surface of said mandrel by drawing the perforate reinforcement from a roll of the perforate reinforcement.

20. A method of forming an inclusion, comprising the steps of:

driving a tubular mandrel into the soil, there being a flexible, tubular, perforate reinforcement about the exterior surface of said mandrel;

withdrawing said mandrel from the soil, injecting flowable cementitious material into the mandrel during withdrawal thereof, and causing the cementitious material to form a columnar body, with portions of the body exuded through the perforations of said reinforcements in order to embed the tubular reinforcement within the body; and wrapping said reinforcement about the exterior surface of said mandrel during said driving of the mandrel into the soil.

21. The method of claim 20, including the step of severing said wrapped reinforcement after said mandrel is fully driven into the soil and said cementitious material has been injected.

* * * * *